US006905122B2

(12) United States Patent
Weigl et al.

(10) Patent No.: US 6,905,122 B2
(45) Date of Patent: Jun. 14, 2005

(54) GAME APPARATUS FOR AND METHOD OF PLAYING A FAMILY OF ASSOCIATED RUMMY-TYPE CARD GAMES

(76) Inventors: William Weigl, 1805 Conwood Dr., Troy, OH (US) 45373; Matthew T. Weigl, 1308 Gibbs. Ct., Bel Air, MD (US) 21014; Margaret R. Weigl, 1805 Conwood Dr., Troy, OH (US) 45373

( * ) Notice: Subject to any disclaimer, the term of this patent is extended or adjusted under 35 U.S.C. 154(b) by 0 days.

(21) Appl. No.: 10/886,737

(22) Filed: Jul. 9, 2004

(65) Prior Publication Data

US 2005/0035551 A1 Feb. 17, 2005

Related U.S. Application Data

(60) Provisional application No. 60/494,111, filed on Aug. 12, 2003.

(51) Int. Cl.[7] ..... A63F 1/00

(52) U.S. Cl. ..... 273/292; 273/274; 273/309; 463/13

(58) Field of Search ..... 273/292, 309, 273/274; 463/13

(56) References Cited

U.S. PATENT DOCUMENTS

| | | | | | |
|---|---|---|---|---|---|
| 5,320,356 | A | * | 6/1994 | Cauda | 273/292 |
| 5,366,228 | A | * | 11/1994 | Kangsanaraks | 273/292 |
| 5,407,209 | A | * | 4/1995 | Prerost | 273/292 |
| 5,409,237 | A | * | 4/1995 | Marcley et al. | 273/299 |
| 5,529,309 | A | * | 6/1996 | Bartlett | 273/292 |
| 5,568,924 | A | * | 10/1996 | Katsuren | 273/292 |
| 5,601,488 | A | * | 2/1997 | Kadlic | 463/13 |
| 5,711,526 | A | * | 1/1998 | Van Hollebeke | 273/303 |
| 5,853,325 | A | * | 12/1998 | Kadlic | 463/13 |
| 6,247,697 | B1 | * | 6/2001 | Jewett | 273/292 |
| 6,651,984 | B1 | * | 11/2003 | Luken | 273/292 |
| 6,685,189 | B2 | * | 2/2004 | Cherven | 273/304 |
| 6,715,762 | B2 | * | 4/2004 | Simmons | 273/429 |
| 2003/0165805 | A1 | * | 9/2003 | Dillhoff | 434/433 |
| 2004/0090007 | A1 | * | 5/2004 | Simmons, Jr. | 273/292 |

OTHER PUBLICATIONS

Walter B. Gibson, HOYLE'S modern Encyclopedia Of Card Games—1974– Doubleday—pp. 290–294.*

* cited by examiner

*Primary Examiner*—Stephen Blau
*Assistant Examiner*—Dolores R. Collins

(57) ABSTRACT

A rummy-type card game that conventionally includes the making and rearranging of RUNs and SETs on a playing surface is played by utilizing a wild card as a substitute for a numbered card. The numbered card that the wild card represents may later be substituted at least from hand by any player for the wild card and the extracted wild card then used to replace another numbered card already on or added to the playing surface. If a wild card is present in a RUN, that grouping becomes locked (unbreakable) from rearrangement until such time as the wild card has been properly replaced during play. In the preferred version of this game, a wild card can only be used in a RUN, and one of several different techniques can be employed to neutralize the locked aspect of a RUN that contains the wild card. Another novel feature is that a wild card may also be used to extract any numbered card from a RUN, including a locked RUN, and the extracted numbered card may then used to that player's best advantage. A further significant feature is to provide non-suit dual-function cards that can be optionally used either as wild or penalty-imposing cards.

10 Claims, 4 Drawing Sheets

ZW

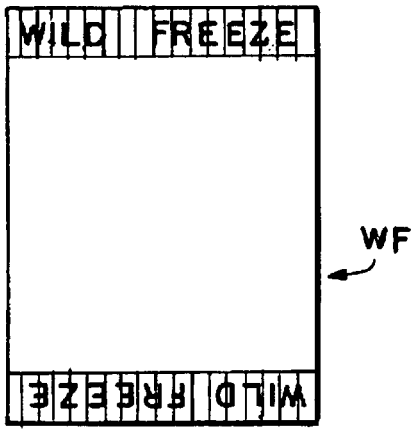
FIG. 8
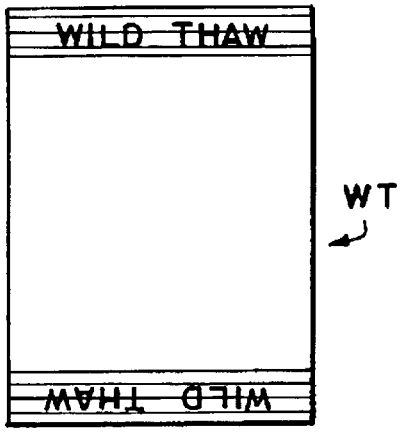
FIG. 9
FIG. 10
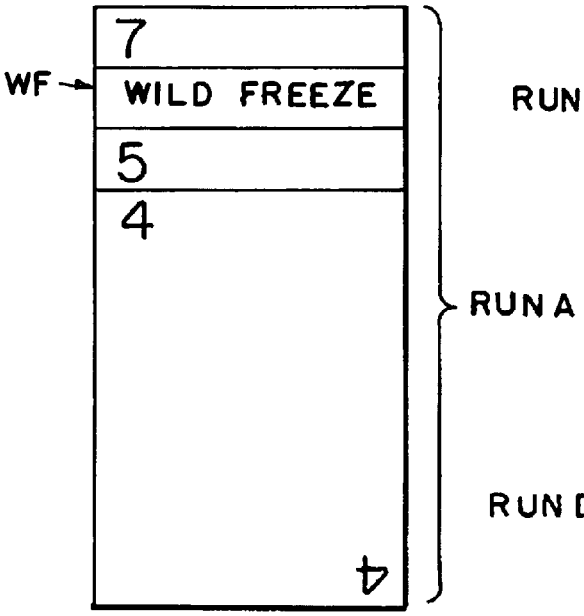
FIG. 11
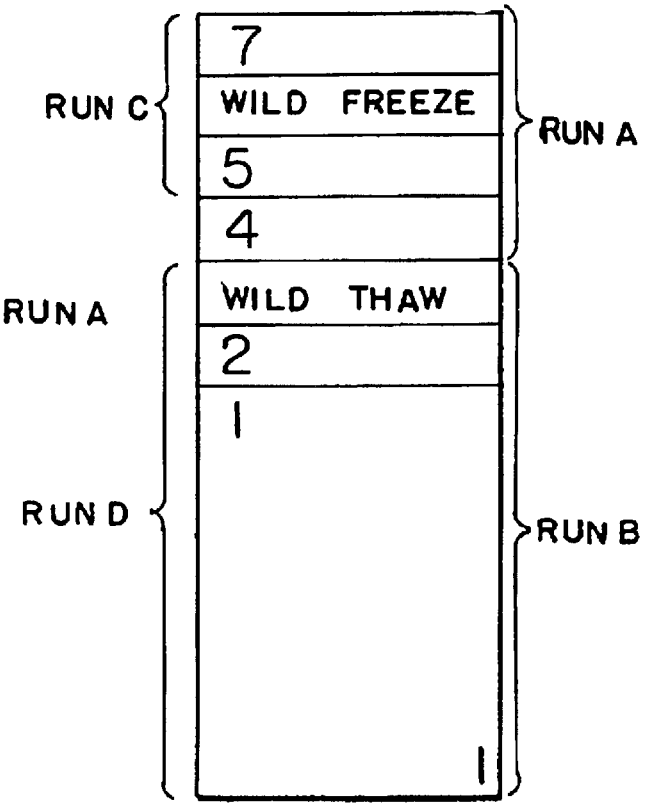

GAME APPARATUS FOR AND METHOD OF PLAYING A FAMILY OF ASSOCIATED RUMMY-TYPE CARD GAMES

This application claims the benefit of provisional application Ser. No. 60/494,111 filed on Aug. 12, 2003.

This invention relates to an apparatus for and method of playing a rummy-type card or tile game, and in particular to such a game which includes wild cards that provide unique play characteristics enabling the wild cards to be substituted for numbered cards and vice versa under certain conditions and rules of play. In addition, the game relates to a card game and playing method wherein a RUN with a wild card is unbreakable, but under certain conditions, can be made breakable even though it contains a wild card. The game further includes a non-suit card or cards that provides the dual function of use as either a wild or a penalty-imposing card. Several varieties of the basic game are discussed, different ones of which can be played according to the degree of complexity and strategies desired. This application is based in part on U.S. Provisional patent application Ser. No. 60/494,111 filed Aug. 12, 2003.

BACKGROUND

Rummy games typically include creating and melding SETs of three or more cards of the same card number but of any of multiple card suits, or RUNs of three or more sequentially-numbered cards of the same suit. Many rummy games incorporating different types of play and a large variety of rules have been developed over a substantial period. It is known, for example, to deal three cards to each of two or more players and require the first player to draw cards one at a time from a face-down draw pile until that player can meld onto a table or other playing surface either a SET, a RUN or both, each consisting of at least three cards. The next-following player must then either add at least one card to an exposed melded SET or RUN or must draw cards from the deck until he can lay down at least one card on an existing SET or RUN or establish a new SET or RUN. Similar play continues until one player has disposed of all cards in his or her hand, ending the game, typically referred to as "going out".

It is also known in a rummy tile game to utilize wild tiles in place of missing numbered tiles when melding a RUN or SET. Any player can then extract the wild tile by substituting the appropriate numbered tile for the missing tile that the wild tile represents. The extracted wild tile can then be added by that player to any existing RUN or SET on the table or be used with tiles from his hand or from the table to create a new RUN or SET, by having the wild tile now represent another different-numbered tile. In another aspect of the above game, tiles may be rearranged to make up new SETs or RUNs, with the exception that a SET or RUN containing a wild tile cannot be broken until the wild tile has first been extracted by substituting the numbered tile that it represents. This simply means that a RUN containing four or more tiles at least one of which is wild cannot have a numbered tile removed nor can it be rearranged into separate RUNs, although it can have tiles added to at either end, if not yet complete. Such unbreakable RUN or SET requires replacement of all wild tiles therefrom before tile removal or rearrangement is permitted. All of the known rummy games that employ wild cards or tiles require, to the best of our knowledge, use of a double deck of cards or double group of tiles.

BRIEF SUMMARY OF THE INVENTION

A rummy-type card (or tile) game that conventionally includes the making and rearranging of RUNs and SETs on a playing surface is played by utilizing a wild card as a substitute for a numbered card. The numbered card that the wild card represents may later be substituted at least from hand by any player for the wild card and the extracted wild card then used to replace another numbered card already on or added to the playing surface. If a wild card is present in a RUN, that grouping becomes locked (unbreakable) from rearrangement until such time as the wild card has been properly replaced during play. In the preferred version of this game, a wild card can only be used in a RUN, and one of several different techniques can be employed to neutralize the locked aspect of a RUN that contains the wild card. Another novel feature is that a wild card may also be used to extract any numbered card from a RUN, including a locked RUN, and the extracted numbered card may then used to that player's best advantage. A further significant feature is to provide non-suit dual-function cards that can be used either as wild or penalty-imposing cards.

A principal object of the invention is to provide a game apparatus and method of playing a rummy game in which a melded RUN that includes a wild card in place of a numbered card allows the actual numbered card to later be substituted for the wild card it represents and the extracted wild card then be substituted for any numbered card in the same or another previously-melded RUN on the table.

An alternative principal object is to utilize a wild card to extract a numbered card from any melded RUN and the numbered card then used with previously-melded cards or with other cards from hand.

A further object is to provide for an increased variety of ways to meld, rearrange and substitute cards in a rummy game so as to enable use of only a single standard deck of cards without or with only a nominal number of "stymies".

Another object is to enable the substitution play of a numbered card for a wild card followed by the substitution of that wild card for another numbered card in the same single playing turn of an individual.

Still another object is to provide for free substitution of a wild card for a numbered card in a RUN or SET that is otherwise locked from rearrangement.

It is also an object to provide for the locking of RUNs against rearrangement by virtue of a wild card being present therein, and to further provide any one of several techniques for unlocking that RUN despite its containing a wild card.

An ancillary object is to lock or unlock a RUN according to the number of wild cards contained therein.

A further object is to provide an embodiment of the game to be played with more than one type of wild card, each different type providing different play functions.

Another object is to provide a non-suit dual-function card that can be used either as a conventional wild card, or can be selectively elected to be passed to an opponent as a penalty-imposing card effecting loss of play by the opponent at his or her next regular turn.

Other objects will become apparent from the following description in which reference is made to the accompanying drawings.

BRIEF DESCRIPTION OF THE DRAWINGS

FIGS. 8 and 9 illustrate two different types of wild cards that can be used respectively for locking and unlocking of RUNs.

FIGS. 10 and 11 illustrates locking and unlocking of a RUN with wild cards of FIGS. 8 and 9.

DESCRIPTION OF PLAY

Figure 7:
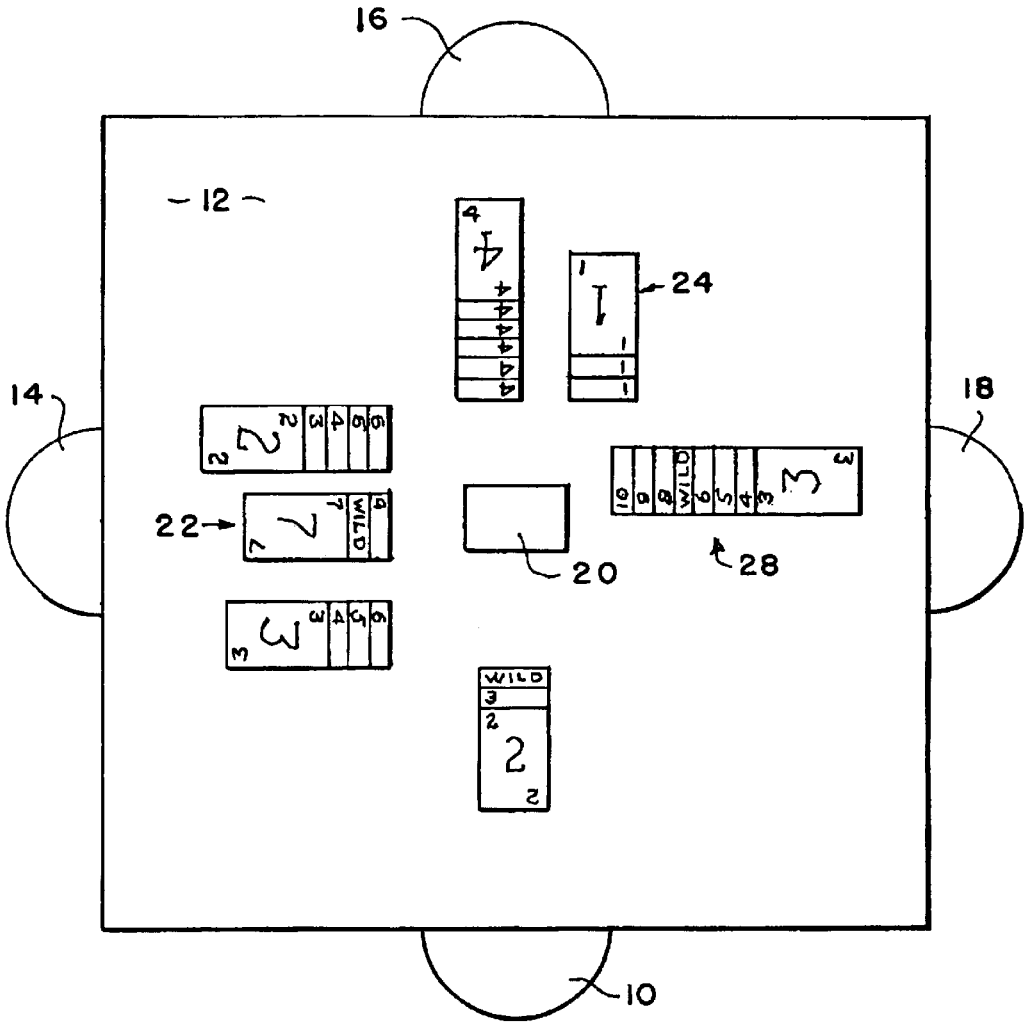
FIG. 7 is a simplified plan view of play of the game at a square table by four players, with several SETs and RUNs melded on the table during play.

In this description, the term "suit" shall be used to mean that one group of sequentially-numbered cards has a characteristic distinguishing it from all other comparable groups of cards. Conventional playing cards have distinguishing suit shapes such as spades, hearts, diamonds and clubs. Those shapes can be used in the game about to be described and for play of the game internationally where they are well recognized, may be preferable. But, for purposes of developing mathematical and perceptional skills in youth, we will describe the game in terms of using color suits such as in FIG. 1 where, from left to right, the "suits" are red, blue, green and yellow. Each card is printed so that the card number and color appears in the upper left hand comer when viewed upright, and the number is inverted at the lower right hand corner. As will be seen, this enables viewing the number of at least the lowest card of a RUN or SET upside down from across a table when displayed in descending shingled fashion as shown in FIG. 7.

Figure 1:
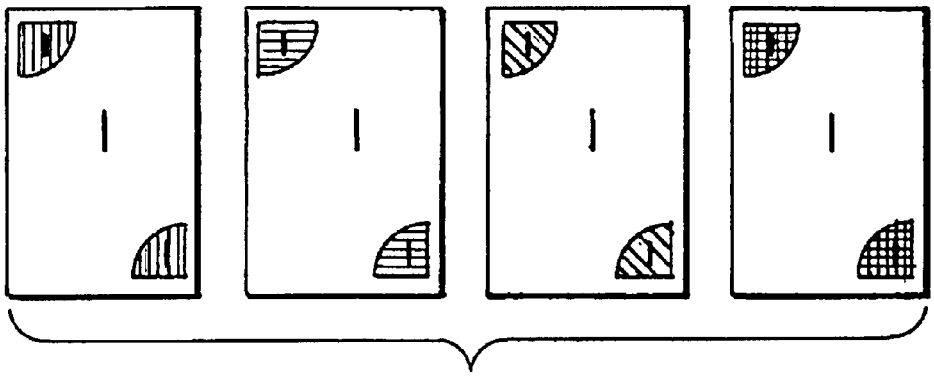
FIG. 1 is a showing of one numbered card from each of four separate color-distinguished card suits.
Figure 2:
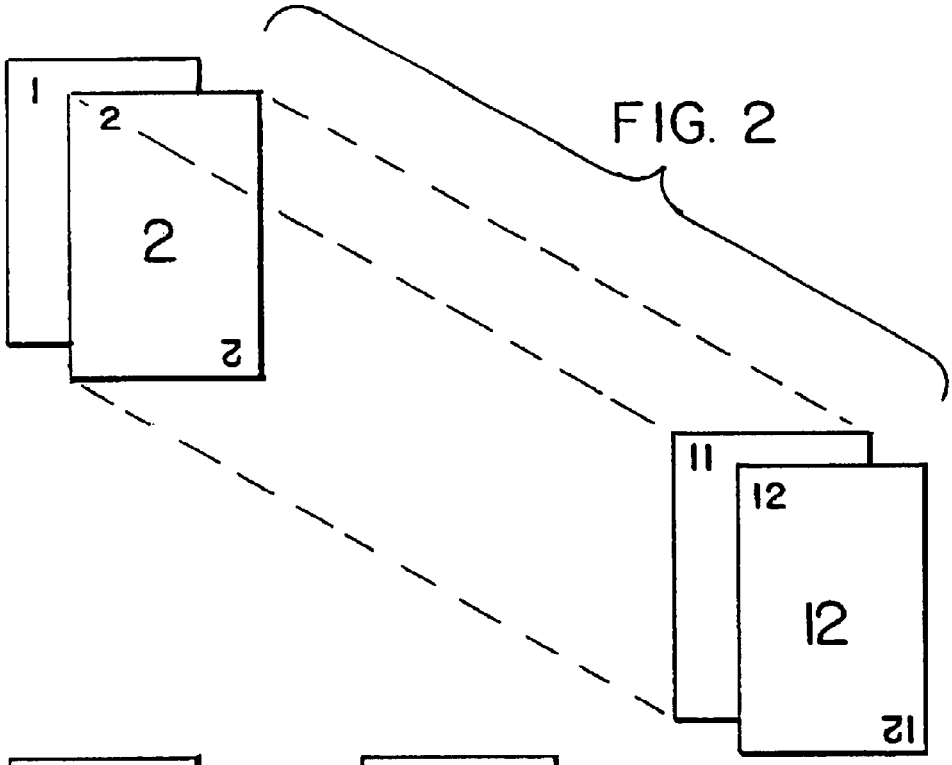
FIG. 2 illustrates the sequentially-numbered cards of one of the suits of a single deck of the cards of FIG. 1.
Figure 4:
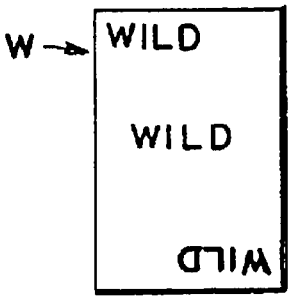
FIG. 4 shows one of multiple wild cards that may be used in place of any numbered card in any suit as a substitute therefor.
Figure 5:
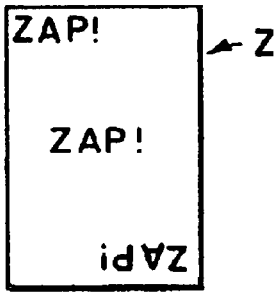
FIG. 5 shows a ZAP! card that may be used to add further strategy and interest to the game.
Figure 3:
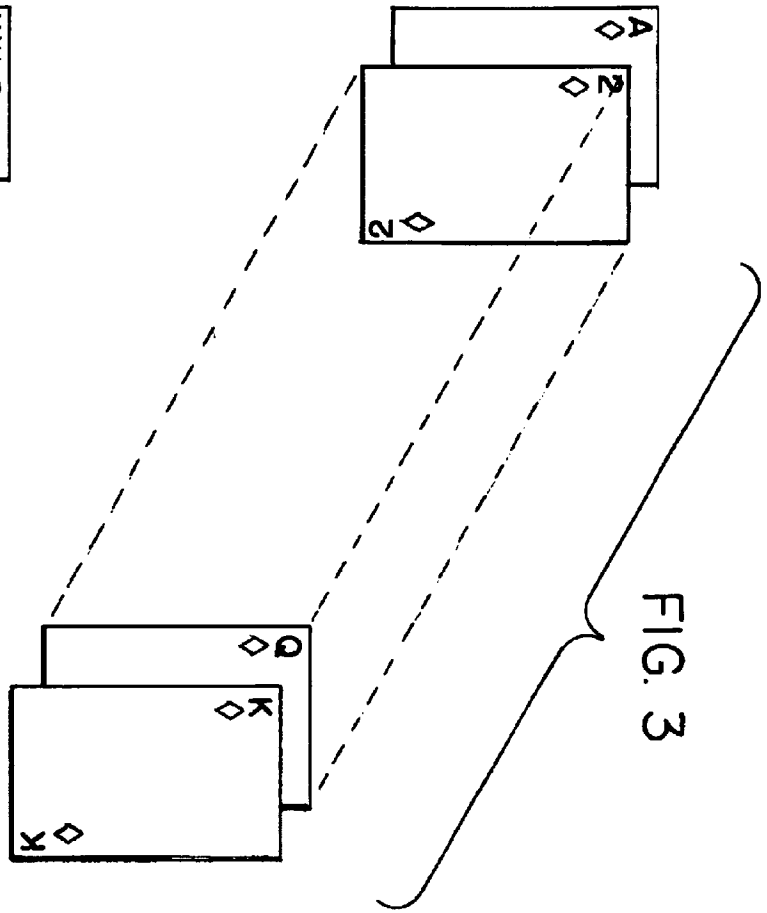
FIG. 3 is a view similar to that of FIG. 2, but utilizes a standard deck of cards from Ace through King of the suits of spades, hearts, diamonds and clubs.
Figure 6:
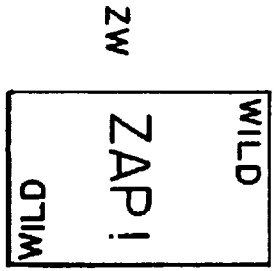
FIG. 6 shows a dual-function card that is selectively usable as either a wild or a penalty-imposing card in either of the decks of FIGS. 2 or 3.

In FIG. 2, twelve cards of one of the suits of FIG. 1 are numbered 1 through 12. Four different suits, also being the conventional suit number in standard playing card decks as shown in FIG. 3, are used. We have found that a single deck using four 12 or 13 card suits as in FIGS. 2 and 3, four wild cards W of FIG. 4 and two ZAP! cards Z of FIG. 5 is suitable for play by two to six persons. The game is especially suitable for play by two persons, ideal for a senior or young couple. Experimentation also shows that a more recent game version discussed in connection with the dual function ZAP!—Wild card of FIG. 6 may provide greater excitement and a higher, more challenging level of difficult strategies for more sophisticated adult players. Surprisingly, the use and varied capabilities of the wild cards in the manner about to be disclosed allow a player to go out even though the single deck has been depleted, by simply continuing sequential play until someone either goes out or no one can (or chooses not to) play further. This latter rare situation is referred to as a "stymie". Obviously, the number of suits, the number of cards in a suit and the number of wild cards contained in the deck are matters of choice and can be varied. One function of ZAP! cards is found in other rummy games, where they are used solely for skipping purposes. Further, in the preferred form of the game, limiting wild cards to use with RUNs only and the capability of both locking and unlocking RUNs containing a wild card are features which can be employed separately, or dispensed with or varied, without departing from the spirit of the invention. Additionally, we contemplate the potential use of double decks of cards, especially where there are more than four players (but which is useful also for any number of players) to provide for different types of play strategies.

Since play of the wild cards is a key to all of the various versions, the method will be described first in terms of how wild cards are played from one's hand. Play with a single deck is preferred since the strategies associated therewith require considerable thought during play. However, for simplicity especially for unsophisticated beginners, we illustrate play with a double deck. The play strategies can differ considerably when playing with a single or double deck, the latter allowing a higher percentage of luck as compared to skill, than the former.

Each double deck suit contains two sets of cards, preferably numbered 1 through 12, thus making it clear that the red suit, for example, has two red 1's, two red 2's, etc. With the dealing player located at seat 10 at the lower end of a table 12 in FIG. 7, six cards are dealt clockwise to himself and each of three other players in seats 14, 16 and 18 in the example shown. (Hereinafter, numerals 10, 14, 16 and 18 will be referred to as players rather than seats.) Let us assume that player 14 has been dealt a yellow 12, a red 9, a red 5, a blue 3, a green 1 and a wild card. In our preferred rules of play, since player 14 cannot meld or lay down a three card SET or RUN from the cards he has been dealt, he must draw one card from the top of a residue deck or draw pile 20 that has been placed face down in the center of table 12. If he can then form a SET or RUN from the seven cards now in his hand, he can meld or play it onto the surface of table 12 after he has drawn. If he either cannot or chooses not to meld at that time, he can pass and player 16 repeats the process. But, assuming that by drawing the card from deck 20 player 14 acquires a red 7, he can now make the red 7, wild card and red 9 into a three-card RUN and place it on the table as shown at RUN 22, completing his turn. In our preferred form of the game, only RUNs may include wild cards. I do not wish to be so limited, however, since a simpler, less difficult form of the game can also be played with both SETs and RUNs containing wild cards. Nor do we wish to be limited to requiring drawing but a single card at each turn. The game is also playable by first player 14 drawing one card at a time until a he can lay down at least one card, but we have found this to unnecessarily slow down the game, especially when played by five or six persons. This also frequently results in the first player holding an excessive number of cards. Also to speed up the game, we prefer to arbitrarily establish a rule that no more than three cards can be laid on the table at one turn. This enhances the game by inhibiting the accumulation of cards in hand by one or more players, potentially defeating the purpose of the game, which is to dispose of the cards in hand as soon as possible.

Assume next that player 16 has been originally dealt a red 10 along with five other cards. At his turn, he can immediately play the red 10 above the red 9 of RUN 22 previously played on the table by player 14 and pass. Or, if desiring to take a risk and save the red 10 for later play, he can draw a card from the deck 20. Let's assume he had a pair of 1's and drew a third 1. He can then lay down a SET of three 1's as SET 24 at his location. He plays these after his draw but before passing, but cannot play the red 10 until a later turn. If he received no help from the draw, he could then play the red 10 and pass. But since the object is really to get rid of cards, especially the higher numbered cards, as quickly as possible and go out, he would be taking a chance of someone else possibly going out before his next turns comes up. It is his option to either play the red 10 on RUN 22 immediately or to draw for some other help.

Suppose now that the third player 18 has been dealt a blue 12, a red 12, a red 8, a green 5, a red 2 and a yellow 1. He can immediately substitute the red 8 for the wild card in RUN 22, and in the preferred version of the game he may take and keep the wild card in his hand for later play if not immediately usable on the table. Since it is best that he make good use of the wild card, his best choice would be to draw a card from the deck 20 in the hope that he receives a card of a suit that allows him to lay down a full RUN of his own. Assume that he picks up a green 6. His move should then be to substitute the red 8 for the wild card in RUN 22 and play the green 5, green 6 and wild card as a new RUN that is shown as the middle section of a RUN 28. The player can put the wild card at either end of the green 5 and 6, but if he also has a green 10 in hand, it is strategically preferable to put it in place of where the green 7 should go. Then, if other players add the green 8 and 9 to the RUN as seen at the top of RUN 28, he can lay down the green 10 at a subsequent turn.

As a key to making the game one that requires a high percentage of imagination and strategy rather than luck, a RUN containing a wild card is said to be locked or unbreakable, although it may be added to at either of its ends. Note that the red RUN 22 would no longer have a wild card, since the red 8 played by player 18 displaced the wild card. If after several additional plays a red 6 and 5 are also added to RUN 22, a player with a second red 7 (possible only in the double deck version of the game) can then rearrange the now five-card RUN 22 into two separate red RUNs of 5, 6, 7 and 7, 8, 9 (not shown). A standard rule of this type of rummy game is that all rearranged RUNs and SETs be at least three cards in length at completion of a player's turn. The above rearrangement of cards would accomplish that end.

A player holding a wild card, either by having it originally dealt to him, by picking it up from deck 20 or by substituting the appropriate numbered card for a wild card in an existing RUN and extracting it from that RUN, may use the wild card by substituting it in place of any numbered card in another RUN already exposed on the table. This includes enabling placing the wild card in an otherwise locked RUN, i.e., one already containing a wild card. This latter function is an exception to the locked status of a RUN containing a wild card. If a numbered card exists in a melded SET that includes four or more cards, we prefer to allow that numbered card to be removed from the SET and substituted for a melded wild card it represents. That wild card can then be used elsewhere or taken into hand for future play. Obviously, when playing with a single deck, a SET cannot contain more than four cards, and a person holding the fourth card of a SET in hand of an already-melded three card SET can effectively control access to the wild card represented by one of the cards in the melded SET. If wild cards are desired to be played in both RUNs and SETs in an alternate version of the game, the feature also allows for the wild card to be used to replace any numbered card in a three card SET, to obtain a numbered card of a specific suit in order to lay down a new RUN in that suit.

It can be seen that the wild cards of the basic game version serve multiple purposes, either to replace a numbered card or to be replaced by a numbered card that the wild card represents. These multiple potentials of a wild card adapt the game for unique strategies described above and make for a novel method of playing the game of rummy. The wild card is preferably neutral in color. Or, since it can be used in any of four different color suits, ideally each different letter of the word "wild" will be in one of the color suits, or the word WILD or W can be printed in black to stand out from the various suit colors and the card numbers.

The ZAP! cards of FIG. 5 in the thus far described game version are preferably four in number in a double deck, two in a single deck. A player holding a ZAP! card may play it face up in front of any other player as one of the cards of his three card play. The player receiving the ZAP! card loses his next turn, turning the ZAP! card face down and out of play when actually skipped. Preferably, at the time a player is skipped, he must also make a blind draw of one card from the player who had "zapped" him, but cannot play anything from his hand at that turn. If scoring is done by counting card values against a player when another "goes out", the ZAP! card is considered as being "in hand" until the player is actually skipped, thus counting against the skipped player.

In another minor version of the double deck game, with wild cards being usable in both RUNs and SETs, and with four additional wild cards added to the deck, a RUN can be converted into a SET and vice versa, by permitting as few as only one numbered card to be used with two or more wild cards. For example, assume a RUN like 22, red 7, wild, and red 9. If a wild card is substituted for the red 9, and the remaining three-cards are red 7, wild, and wild, a second 7 of any color can be substituted for one of the wild cards, now converting the former RUN into a new SET. Obviously, the reverse of that procedure can also be followed to convert a SET into a RUN in the game version where wild cards are used in both.

Scoring can be any of the types commonly used in rummy games, by counting point values of cards remaining in hand as negative points when another goes out, or by the number of games won. We prefer to have each numbered card counted at face value, also counting 25 points each for wild and ZAP! cards. Obviously, low score wins.

Since filing the above-identified U.S. Provisional patent application, we have discovered yet another aspect of the game that requires a higher level of decision making and exciting strategy and play. This is occasioned by using dual-function ZAP-Wild cards ZW of FIG. 6 in place of the separate wild cards W of FIG. 4 and the ZAP! cards Z of FIG. 5. In those two figures. each card W or Z had but one function. The ZAP—Wild card ZW, preferably four in number in a single deck, can be used with either the numbered deck of FIG. 2 or the standard Ace through King deck of FIG. 3.

During the early stages of play, cards ZW are used primarily as wild substitute cards to meld and thereby reduce the holdings of cards in hand. As play progresses, certain strategies allow one holding key cards to control access to the ZW wild cards on table, preserving them for use as ZAP! cards against an opponent who appears about to go out. Each time a player is zapped and the ZAP! card is turned face down out of play, there is one less wild card in the deck. Oftentimes, all four cards ZW are taken out of play for zapping purposes before someone can go out. An example of this approach, referring back to FIG. 7, anyone holding the red 8 of RUN 22 in his hand is in a controlling position to gain access to the wild card of RUN 22 and use it to zap an opponent who appears to be running short of cards in his hand. Or, suppose that red 8 is already on the table in a melded three-card SET of 8's. The player holding the fourth card of that SET is in a position of accessing the red 8 in the SET of 8's by adding the fourth 8 to the SET, pulling the red 8 and then substituting the red 8 for the wild card of RUN 22. With the wild card, he now has the threefold decision-making option of using the wild card as such for melding purposes, zapping an opponent, or taking the card into hand and postponing that decision. Surprisingly, if the latter option is exercised and someone goes out before he has played the ZW card, he may be penalized severely depending on the type of scoring that is used.

In another game variation, we incorporate the use of wild cards in RUNs only, with a RUN containing a WILD FREEZE card WF (FIG. 8) being locked as with the wild card shown in RUN 22 shown of FIG. 7. This is illustrated in FIG. 10 where a WILD FREEZE card WF has been laid on the table in RUN A, substituting, for example, for a red 6. As such, the 4, 5 or 7 becomes inaccessible to a player who would like to combine either with a pair of 4's, 5's or 7's to make a SET.

However, if a player has a WILD THAW card WT of FIG. 9, he can remove the 4 from RUN A by either solely substituting the WILD THAW card WT for the 4 or by adding the RUN B (section of FIG. 11) below the red 4. Any WILD THAW card, once replacing a numbered card in or being added to a RUN containing a WILD FREEZE card, neutralizes the effect of the locked aspect of the RUN. It is said that the RUN then becomes "unlocked" or "thawed". This enables any player desiring to remove the red 4 from FIG. 11 to do so, by breaking the remaining red cards into two separate RUNs C and D. After breaking and their separation, RUN C again becomes "frozen" and RUN D becomes "thawed". A WILD THAW card played in a new RUN by itself means that RUN is thawed, not locked.

The FIG. 8 and FIG. 9 FREEZE and THAW cards are preferably designed to stand out visually from the numbered cards of the deck. This can be done pictorially by illustrating ice or flame for a FREEZE or THAW card respectively. Alternatively, the former can be blue across at least the entire top and bottom, and the latter red, since blue and red are internationally recognized colors for "cold" and "hot".

A simpler, and in some respects a more preferable way of locking and unlocking RUNs without necessitating the use of special FREEZE and THAW cards is to provide that the existence of but one wild card in a RUN locks the RUN, while existence of two or more wild cards unlocks it. For example, considering the FIG. 11 depiction as being absent the words FREEZE and THAW, the RUN of FIG. 11 would be unlocked as soon as a second wild card was inserted into it or added to one end. If, at some point, one of the two wild cards is replaced by its corresponding numbered card, the RUN of FIG. 9 would return to its locked state.

It is preferred in the rules of play that no RUN be permitted to have two wild cards touch, i. e., be consecutive. This rule would apply at the time of attempting to substitute a wild card immediately next to an existing wild card as well as to having two wild cards touch after completion of a player's turn.

This rummy game is suitable for individual or partnership play. It may also be played as a progressive party game of two or three tables, using standard bridge tallies for total scores. Many of its features are usable in a solitaire game.

To the extent that the method can be practiced in a card or tile game other than rummy, it is contemplated to be within the scope of the claims. Additionally, the game can be adapted for use in an electronic hand-held game or on the world wide web for individual or interactive group play. Various other changes can be made without departing from the spirit of the invention.

Having described our invention, we claim:

1. In a method of playing a rummy-type game by a plurality of individual players with discrete elements from a supply comprising multiple suits of consecutively-numbered flat elements and at least two discrete flat wild elements, each said element having opposing sides with a distinct playing face on one side of each and all of said elements having a common back appearance on the sides opposite said faces, said method comprising the steps of:

a. presenting all of said elements in a position of access to all of said players with their back sides facing upwardly;

b. providing a playing surface for melding of three-element sets of identically-numbered elements and runs of three-element sequentially-numbered and same suit elements within easy arm reach of all of said players;

c. establishing a deal of a hand of play whereby each player receives a predetermined number of elements the faces of which only a receiving player can view;

d. playing individually in succession until one player has completely depleted his supply of elements onto said playing surface from those originally dealt and from any received from the supply during play of the hand;

e. establishing at least one run on the playing surface by melding a sequence of at least three elements, one of which three is a wild element occupying the position of a missing numbered element of the same suit, said one run being locked against rearrangement due to the presence of said wild element therein but being eligible to receive elements added to either end of said run; and f. adding a second wild element to said one run to effect unlocking and enabling rearrangement thereof.

2. The method performed according to the steps of claim 1 wherein the supply consists of a single deck of playing cards having four suits.

3. The method performed according to the steps of claim 1 wherein said supply comprises four double suits of elements.

4. The method performed according to the steps of claim 1 wherein said discrete wild elements can be selectively elected by any given player to substitute either as a wild element in place of a numbered element of a run, or as a penalty-imposing element requiring an opposing player to whom said element is given to lose an opportunity to play at his next regular turn.

5. The method performed according to the steps of claim 1 and further including the step of substituting a wild element from a player's hand for a numbered element of said at least one melded run and extracting the numbered element from said melded run for use elsewhere.

6. The method performed according to the stops of claim 1 including the additional step of removing either one of said wild elements from an unlocked run to restore at least one portion of said run to its locked condition.

7. In a method of playing a rummy-type game that includes providing a supply of playing elements, which supply consists of distinctive multiple suits each of which suits comprises consecutively-numbered elements for use in the making of three-element sets of identically-numbered elements from different suits and three-element runs of sequentially-numbered elements of the same suit, said runs and sets being playable on a playing surface either by rearrangement, adding to or substitution of elements by any of the players in a particular rummy game, and said supply having at least one first wild element substitutable for any given element in any run and, when so substituted, a run containing said at least one wild element normally becoming unbreakable except by replacement of the first wild element in that run by the actual playing element that the first wild element represents, the improvement comprising;

neutralizing the unbreakability effect of said run by adding thereto at least one second wild element to render it newly breakable.

8. The invention of claim 7 wherein one of said elements has a visual representation connoting unbreakability of a run containing said one wild element, and wherein the other of said wild elements has a visual representation connoting neutralization of the unbreakability of said specific run containing the said one wild element.

9. The method performed according to the steps of claim 7 wherein said wild elements can be selectively elected by any given player to substitute either as a wild element in place of a numbered element of a run, or as a penalty-imposing element requiring an opposing player to whom said element is given to lose an opportunity to play at his next regular turn.

10. The method performed according to the steps of claim 7 wherein the additional step of removing either one of said wild elements from a breakable run restores at least one portion of said run to its condition of unbreakability.

* * * * *